US005267454A

United States Patent [19]

Gregory

[11] Patent Number: 5,267,454

[45] Date of Patent: Dec. 7, 1993

[54] UPHOLSTERY FABRIC

[75] Inventor: Giles T. Gregory, Mansfield, United Kingdom

[73] Assignee: General Motors Corporation, Detroit, Mich.

[21] Appl. No.: 3,007

[22] Filed: Jan. 11, 1993

[30] Foreign Application Priority Data

Jan. 16, 1992 [GB] United Kingdom ..... 9200941

[51] Int. Cl.[5] ..... D04B 7/04

[52] U.S. Cl. ..... 66/196; 66/198; 66/202; 428/253

[58] Field of Search ..... 66/196-200, 66/202; 428/253

[56] References Cited

U.S. PATENT DOCUMENTS 3,808,843 5/1974 Blore et al. ..... 66/196

*Primary Examiner*—James J. Bell

*Attorney, Agent, or Firm*—Davis Hoxie Faithfull & Hapgood

[57] ABSTRACT

An upholstery fabric of enhanced stability is formed of knitted double jersey construction and has (i) a visible face side and (ii) a rear face side of principally bird's eye structure. The fabric has on its visible face side zones of a bird's eye structure, there being on the rear face side of the said zones a plain structure.

9 Claims, 1 Drawing Sheet

UPHOLSTERY FABRIC

TECHNICAL FIELD

This invention relates to fabrics and has particular reference to knitted upholstery fabrics.

DISCUSSION OF PRIOR ART

In GB-A-2,223,035, the contents of which are incorporated herein by way of reference, there is described a weft knitted double jersey upholstery fabric.

The fabric described in the specification has a structure providing a bird's eye effect on the rear face side and a plain appearance on the visible face side of the fabric.

The present invention provides a fabric having, in part, a bird's eye effect on both sides.

SUMMARY OF THE INVENTION

By the present invention there is provided an upholstery fabric of knitted double jersey construction having:

(i) a visible face side and (ii) a rear face side of principally bird's eye structure, which is characterized in that the fabric has on its visible face side zones of a bird's eye structure, there being on the rear face side of the said zones a plain structure.

The fabric may be knitted from textured continuous filament synthetic yarn on a machine having a gauge in the range 10 to 14 to give, in the relaxed state, a fabric having from 4 to 6 wales per cm and from 10½ to 22 courses per cm. The yarn used preferably has a count in the range 550 to 850 decitex and a preferred yarn is air textured polyester.

It has been discovered that this type of fabric construction is stable and may be used to good effect in the formation of upholstered seats particularly for use in vehicles.

It has further been discovered that if a fabric having a bird's eye structure on the rear face side also has a bird's eye structure in register on the visible face side, an unstable structure is produced which both stretches and s liable to rapid deterioration. The provision of a plain structure on the rear face side of the zones where there is the bird's eye structure on the visible face side so that the visible face and rear face zones are substantially in register provides a balance which enables a satisfactory upholstered structure to be formed.

It will be appreciated that there need not be an exact register between the visible face and rear face zones, but as the amount of register reduces, the benefits of the invention are gradually lost.

BRIEF DESCRIPTION OF THE DRAWINGS

By way of example, embodiments of the present invention will now be described with reference to the accompanying schematic drawing, of which.

DESCRIPTION OF PREFERRED EMBODIMENT

Figure 1:
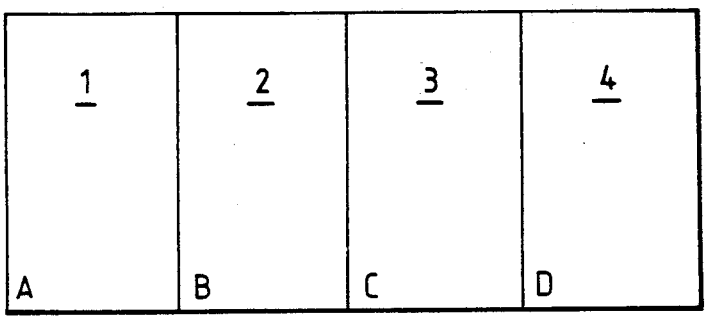
FIG. 1 is a block diagram showing a portion of fabric.

The method of knitting the type of fabric illustrated in the drawing is in itself well known. Reference is made to GB-A-2,223,035 mentioned above as giving ways of knitting such a fabric material. The invention is concerned with the structure of such a fabric which may therefore be knitted in manners known per se.

Referring to FIG. 1 it can be seen that there are four side-by-side zones. The left hand zone 1 has a bird's eye structure on the rear face side with colour 1 on the visible face side, the zone 2 has a bird's eye structure on the rear face side with colour 2 on the visible face side, the zone 3 has a bird's eye structure on the visible face side and colour 1 on the rear face side and in zone 4 there is a bird's eye structure on the visible face side with colour 2 on the rear face side. Each zone is 6 wales wide.

Figure 2:
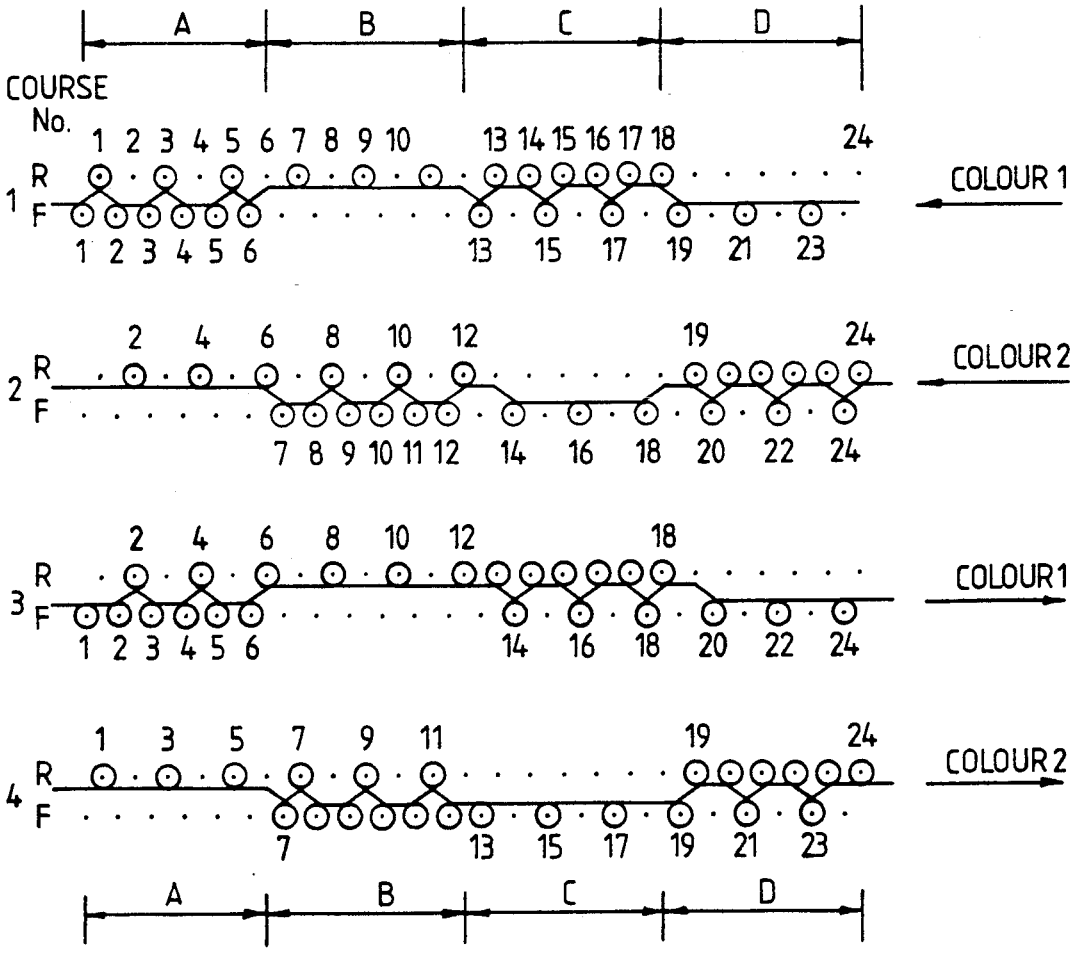
FIG. 2 shows a stitch diagram which permits the manufacture of the fabric shown in FIG. 1.

Illustrated in FIG. 2 is the stitch diagram which permits the structure of FIG. 1 to be manufactured. It can be seen that in the stitch diagram there is produced a structure by the use of two different yarns, one of colour 1 and the second yarn of colour 2. The structure is knitted in four courses on a two bed knitting machine having a rear bed R and a front bed F.

In FIG. 2 there are four adjacent zones, A, B, C and D. Zone A corresponds to zone 1 of FIG 1, zone B corresponds to zone 2 of FIG. 1, zone C corresponds to zone 3 of FIG. 1 and zone D corresponds to zone 4 of FIG. 1. In the first course (course No. 1) the first colour of yarn is knitted right-to-left. For convenience, however, the knitting is described from left to right. In zone A knitting is effected on the rear bed on alternate needles 1, 3 and 5 and on all needles on the front bed. In zone B alternate needles 7, 9 and 11 are knitted on the rear bed and no needles are knitted on the front bed. In zone C all needles are knitted on the rear bed and alternate odd numbered needles are knitted on the front bed. In zone D the knitting occurs only on alternate odd numbered needles on the front bed.

In course No. 2, yarn of colour 2 is also knitted right to left but is again described from left to right. In zone A knitting is effected on the even numbered needles on the rear bed and is not knitted on any needles of the front bed. In zone B the yarn is knitted on the even numbered needles of the rear bed and on all needles on the front bed. In zone C the yarn is knitted only on the even numbered needles of the front bed and is not knitted on any needles of the rear bed. Finally, in zone D the yarn is knitted on all needles of the rear bed and on only the even numbered needles on the front bed.

In course No. 3, in zone A, yarn of colour 1 is knitted left to right on all of the needles on the front bed but only on the even numbered needles of the rear bed. In zone B the yarn is knitted only on the even numbered needles of the rear bed and :s not knitted on the front bed. In zone C the yarn is knitted on all needles of the rear bed and on the even numbered needles of the front bed. Finally, in zone D the yarn is knitted only on the even numbered needles of the front bed.

In the final course of the sequence (course No. 4) yarn of colour 2 is knitted left to right in zone A only on the odd numbered needles of the rear bed. It is not knitted on any needles of the front bed. In zone B the yarn is knitted on all of the front needles and only on the odd numbered needles on the rear bed. In zone C the yarn is knitted on the odd numbered needles on the front bed and is not knitted on the rear bed. Finally in zone D the yarn is knitted on all of the needles on the rear bed and on the even numbered needles on the front bed.

Such a four-course structure (repeated as often as required) results in the formation of a bird's eye backed structure on the rear face side in zone A with colour showing on the visible face side. In zone B there is a bird's eye backed structure on the rear face side with colour 2 showing on the visible face side. In zone C there is a bird's eye structure on the visible face side with colour 1 showing on the rear face side and in zone D there is a bird's eye structure on the visible face side with colour 2 showing on the rear face side.

Obviously the zones for different bird's eye structures can be of any desired shape to make attractive patterns on the fabric.

If instead of using a plain structure on the rear face side of the fabric, the bird's eye structure were to be used on both the visible face and the rear face sides, the resultant structure would be unstable, and stretchy in both the wale-wise direction and the course-wise direction. Although such stretchy fabric is acceptable in garment manufacture, it is unsuitable for upholstery, as it can move around on the seat core when it is sat upon. The stretchiness also makes damage more likely to occur to the fabric in addition to its instability on the core of the seat.

What is claimed is:

1. An upholstery fabric of knitted double jersey construction having:

(i) a visible face side and (ii) a rear face side of principally bird's eye structure, wherein the fabric has on its visible face side zones of a bird's eye structure, there being on the rear face side of the said zones a plain structure.

2. An upholstered fabric as claimed in claim 1, wherein the fabric is formed on a 10 to 14 gauge knitting machine.

3. An upholstery fabric as claimed in claim 1, wherein the fabric is formed of a yarn having a yarn count in the range 550 to 850 decitex.

4. An upholstery fabric as claimed in claim 2, wherein the fabric is formed of a yarn having a yarn count in the range 550 to 850 decitex.

5. An upholstery fabric as claimed in claim 1, wherein the fabric is formed of a synthetic yarn.

6. An upholstery fabric as claimed in claim 5, wherein the synthetic yarn is a continuous filament yarn.

7. An upholstery fabric as claimed in claim 5, wherein the synthetic yarn is a multi-filamentary yarn.

8. An upholstery fabric as claimed in claim 7, wherein the yarn is an air textured multi-filamentary yarn.

9. An upholstery fabric as claimed in claim 1, wherein the fabric has, in the relaxed state 4 to 6 wales per cm and $10\frac{1}{2}$ to 22 courses per cm.

* * * * *